US006929469B2

(12) United States Patent
Cain et al.

(10) Patent No.: US 6,929,469 B2
(45) Date of Patent: Aug. 16, 2005

(54) BURNER APPARATUS

(75) Inventors: Bruce E. Cain, Akron, OH (US); Thomas F. Robertston, Medina Township, OH (US); Thomas B. Neville, Portola Valley, CA (US); Mark C. Hannum, Aurora, OH (US); John N. Newby, Lexington, KY (US)

(73) Assignee: North American Manufacturing Company, Cleveland, OH (US)

( * ) Notice: Subject to any disclaimer, the term of this patent is extended or adjusted under 35 U.S.C. 154(b) by 0 days.

(21) Appl. No.: 10/375,781

(22) Filed: Feb. 26, 2003

(65) Prior Publication Data

US 2005/0074711 A1 Apr. 7, 2005

Related U.S. Application Data

(60) Provisional application No. 60/360,660, filed on Feb. 28, 2002.

(51) Int. Cl.[7] ..... F23D 14/46
(52) U.S. Cl. ..... 431/350; 431/351; 431/8
(58) Field of Search ..... 431/350, 351, 431/8, 9, 285

(56) References Cited

U.S. PATENT DOCUMENTS

| | | | | |
|---|---|---|---|---|
| 3,273,621 A | | 9/1966 | Childree | |
| 3,376,098 A | | 4/1968 | Pryor | |
| 3,729,285 A | | 4/1973 | Schwedersky | |
| 3,736,747 A | | 6/1973 | Warren | |
| 3,848,412 A | | 11/1974 | Michels et al. | |
| 3,907,488 A | | 9/1975 | Takahashi et al. | |
| 3,957,420 A | | 5/1976 | Asai et al. | |
| 3,993,449 A | | 11/1976 | Childs | |
| 4,021,186 A | | 5/1977 | Tenner | |
| 4,052,844 A | | 10/1977 | Caruel et al. | |
| 4,095,929 A | | 6/1978 | McCartney | |
| 4,113,417 A | | 9/1978 | Deruelle | |
| 4,118,171 A | | 10/1978 | Flanagan et al. | |
| 4,351,632 A | | 9/1982 | Nagai | |
| 4,395,223 A | | 7/1983 | Okigami et al. | |
| 4,496,306 A | | 1/1985 | Okigami et al. | |
| 4,505,666 A | | 3/1985 | Martin et al. | |
| 4,533,314 A | | 8/1985 | Herberling | |
| 4,629,413 A | | 12/1986 | Michelson et al. | |
| 4,669,399 A | | 6/1987 | Martin et al. | |
| 4,945,841 A | | 8/1990 | Nakamachi et al. | |
| 5,201,650 A | | 4/1993 | Johnson | |
| 5,263,849 A | | 11/1993 | Irvin et al. | |
| 5,407,345 A | | 4/1995 | Robertson et al. | |
| 5,462,430 A | * | 10/1995 | Khinkis | 431/10 |
| 5,554,021 A | | 9/1996 | Robertson et al. | |
| 5,634,785 A | | 6/1997 | Bury et al. | |
| 5,645,410 A | * | 7/1997 | Brostmeyer | 431/10 |
| 5,667,376 A | | 9/1997 | Robertson et al. | |

(Continued)

OTHER PUBLICATIONS

Robertson, et al.; Application of a Novel Low Nox Combustion System to an Oil Field Steam Generator; Society of Petroleum Engineers, Inc., 1995.

Cain, et al., Reducing $No_x$ Emissions in High–Temperature Furnaces, International Gas Research Conference, Nov., 1998, San Diego CA.

*Primary Examiner*—Alfred Basichas
(74) *Attorney, Agent, or Firm*—Jones Day

(57) ABSTRACT

An apparatus includes a furnace structure defining a reaction zone. A burner structure communicates with the reaction zone through a burner port. The burner port is centered on a burner axis and has a radius. A fuel inlet structure communicates with the reaction zone through a fuel port. The fuel port is centered on a fuel port axis that is spaced radially from the burner axis a distance within a range from about twice the radius to about six times the radius. The fuel port axis is skewed relative to the burner axis to direct the fuel emerging from the fuel port to flow into the reaction zone along a spiral flow path.

15 Claims, 7 Drawing Sheets

U.S. PATENT DOCUMENTS

| | | | | | |
|---|---|---|---|---|---|
| 5,688,115 | A | | 11/1997 | Johnson | |
| 5,730,591 | A | | 3/1998 | Robertson et al. | |
| 5,758,587 | A | | 6/1998 | Buchner et al. | |
| 5,803,725 | A | | 9/1998 | Horn et al. | |
| 5,865,616 | A | | 2/1999 | George | |
| 6,027,330 | A | * | 2/2000 | Lifshits | 431/8 |
| 6,045,351 | A | * | 4/2000 | Dobbeling et al. | 431/8 |
| 6,089,855 | A | * | 7/2000 | Becker et al. | 431/9 |

* cited by examiner

BURNER APPARATUS

RELATED APPLICATIONS

This application claims the benefit of provisional U.S. Patent Application Ser. No. 60/360,660, filed Feb. 28, 2002.

FIELD OF THE INVENTION

The present invention is directed to the field of combustion systems, particularly those of the type with reduced emissions.

BACKGROUND

A burner can be part of an industrial furnace having a process chamber in which a drying or heating process is performed. The burner can have a reaction zone communicating with the process chamber. In a premix burner, a mixture of fuel and oxidant, which is known as premix, is ignited and burned in the reaction zone to provide thermal energy for heating the process chamber.

Secondary fuel may be injected into the reaction zone through secondary fuel injectors. The thermal energy from the combustion of premix supplied by the burner can be sufficient to autoignite the secondary fuel. In order to dilute the secondary fuel, inert gases can be entrained into the secondary fuel stream prior to its combustion. Dilution of the secondary fuel prior to combustion can decrease the amount of localized hotspots during combustion. Decreasing the number of localized hotspots can decrease the amount of $NO_x$ production.

SUMMARY

In accordance with a distinct feature of the invention, an apparatus includes a furnace structure defining a reaction zone. A burner structure communicates with the reaction zone through a burner port. The burner port is centered on a burner axis and has a radius. A fuel structure communicates with the reaction zone through a fuel port. The fuel port is centered on a fuel port axis that is spaced radially from the burner axis a distance within a range from about twice the radius of the burner port to about six times the radius of the burner port.

In accordance with another distinct feature of the invention, a burner structure communicates with a reaction zone through a burner port centered on a burner axis. A fuel structure communicates with the reaction zone through a fuel port. The fuel port is centered on a fuel port axis that is skewed relative to the burner axis.

DESCRIPTION

Figure 1:
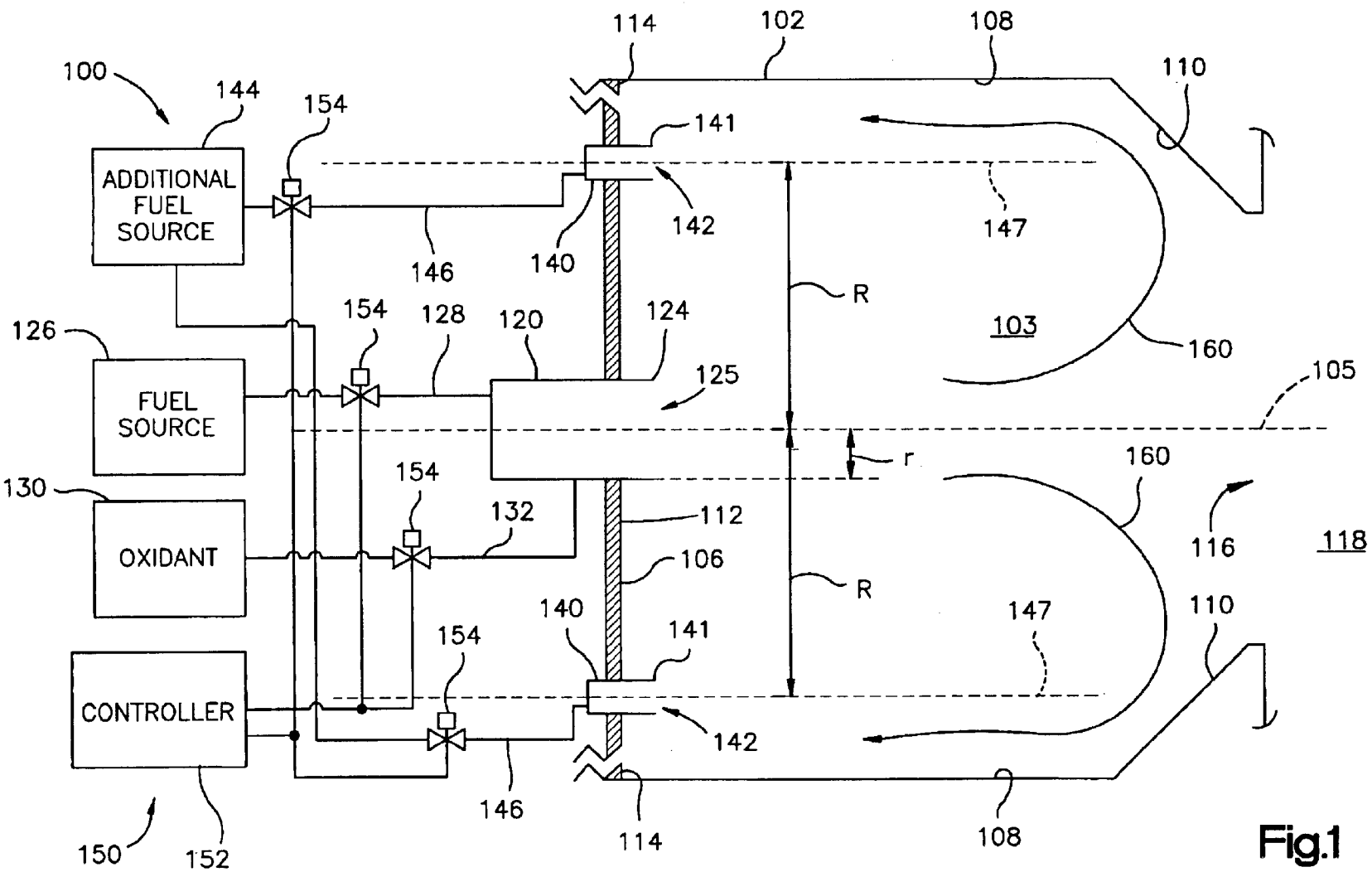
FIG. 1 is a schematic view of an apparatus comprising a first example of the claimed invention.

The apparatus 100 shown in FIG. 1 has parts which, as described below, are examples of the elements recited in the claims.

The apparatus 100 is a furnace for use in steel heating and reheating applications. The furnace 100 includes a furnace wall structure 102 that defines peripheral boundaries of a reaction zone 103. The reaction zone 103 is centered on a burner axis 105. As viewed from left to right in FIG. 1, the furnace wall structure 102 has a first end wall 106, a middle wall 108, and a second end wall 110.

The first end wall 106 is opposite the second end wall 110. Preferably, the first end wall 106 has a planar surface 112 perpendicular to the burner axis 105. The first end wall 106 joins the middle wall 108 at a peripheral edge 114 of the first end wall 106.

The middle wall 108 is located axially between the first and second end walls 106 and 108. It is cylindrical and is centered on the axis 105.

The second end wall 110 defines an exit 116 from the reaction zone 103. The second end wall 110 extends from the middle wall 108 to the exit 116. It has a conical configuration that tapers radially inward, i.e. narrows, as it approaches the exit 116. The conical wall 108 provides a choke configuration to the reaction zone 103 as the reaction zone 103 communicates with a process chamber 118 through the exit 116. The process chamber 118 in this embodiment is a steel heating and reheating furnace chamber.

The furnace 100 further includes a burner 120. An open end 124 of the burner 120 defines a burner port 125. The burner 120 communicates with the reaction zone 103 through the burner port 125. Preferably, the burner 120 is a premix burner. For example, the burner 120 can be the MagnaFlame® LE, commercially available from North American Manufacturing, Co. (Cleveland, Ohio).

In this embodiment, the burner 120 is cylindrical and the burner port 125 is circular and centered on the burner axis 105. The burner port 125 has a radius (r) measured from the burner axis 105 to the edge of the circular open end 124.

A fuel source 126 communicates with the burner 120 through a fuel line 128. An oxidant source 130 communicates with the burner 120 through an oxidant line 132. In this embodiment, the fuel is natural gas and the oxidant is air. The oxidant may be mixed with inert gas, such as recirculated flue gas. The fuel and oxidant are supplied to the burner 120, which in turn can mix the fuel and oxidant to create premix.

In addition to the burner 120, the furnace 100 also includes a plurality of fuel inlet structures 140. The fuel inlet structures 140 are alike and each has an open end 141 that defines a fuel port 142. Each fuel port 142 is centered on a respective fuel port axis 147. Each fuel inlet structure 140 communicates with the reaction zone 103 through its respective fuel port 142.

An additional fuel source 144 communicates with the fuel inlet structures 140 through additional fuel lines 146. The additional fuel source 144 supplies fuel that also is preferably natural gas.

In this embodiment, two fuel ports 142 are shown. In other embodiments, a single fuel port or many fuel ports may be utilized. As the number of fuel ports is increased, the respective diameters of the fuel ports are decreased proportionally to the increased number of fuel ports. This number/diameter relationship maintains a constant or nearly constant ratio of the amount of premix able to flow through the burner 120 to the amount of fuel able to flow through the fuel ports 142, regardless of the number of fuel ports 142. Accordingly, the overall flow area defined by the fuel ports 142 in this embodiment is equal or nearly equal to the overall flow area that would be defined by an array of fuel ports in another embodiment having a different number of fuel ports in the array, but having a burner with the same or a similar flow area.

Each fuel port axis 147 is spaced radially from the burner axis 105 a distance (R) in a range that is about twice the radius (r) to about six times the radius (r). Preferably, the fuel port axes 147 are equally spaced from the burner axis 105. However, they could be spaced distances different from each other so long as the distances from the burner axis 105 are within the above range of about twice the radius (r) to about six times the radius (r). The fuel ports 142 are preferably coplanar with the burner port 125 and with each other, but may be spaced axially from the burner port 125 and/or each other.

A control system 150 includes a controller 152 that controls a plurality of valves 154 independently from each other. The valves 154 are located in the fuel lines 128 and 146 and in the oxidant line 132. Each valve 154 has a closed position blocking the flow through its respective line and an open condition not blocking the flow. Each valve 154 can additionally have partially open conditions that restrict the flow through its respective line.

During operation, the burner 120 mixes the fuel and oxidant to create a mixture of premix. A flow of the premix is supplied from the burner 120 to the reaction zone 103 through the burner port 125 where it is ignited by an igniter, not shown, as known in the art. Preferentially, the premix is directed through the burner port 125 at a velocity in a range from about 69 meters per second (225 feet per second) to about 114 meters per second (375 feet per second).

The fuel inlet structures 140 direct the additional fuel to the reaction zone 103 through the fuel ports 142. Preferably, fuel is directed to flow through the fuel ports 142 at a velocity greater than about 91 meters per second (300 feet per second).

Combustion of the premix in the reaction zone 103 creates combustion products. A recirculation flow of the combustion products 160 is created by the combustion products impinging on portions of the wall structure 102. Once recirculating, the recirculation flow 160 also impinges upon the additional fuel emerging from the fuel ports 142 and thus causes the fuel to flow radially inward toward the burner axis 105. While flowing from the fuel ports 142 toward the flow of premix emerging from the burner port 125 the fuel entrains inert gases. The entrainment of inert gases dilutes the fuel prior to the fuel intersecting and mixing with the premix flow. The dilution of the fuel can consequently produce a lower amount of $NO_x$. An optimum amount of dilution, with a corresponding optimum reduction in $NO_x$, results from the structural arrangement in which R/r is within the range of about two to about six.

The controller 152 controls a ratio of the fuel to the oxidant supplied to the burner 120 by controlling particular valves 154. Specifically, the controller 152 can control the ratio of the fuel to the oxidant in the premix such that combustion of the premix in the reaction zone 103 results in a flame with an adiabatic temperature that is within a range from about 1093 degrees Celsius (2000 degrees Fahrenheit) to about 1427 degrees Celsius (2600 degrees Fahrenheit).

Figure 2:
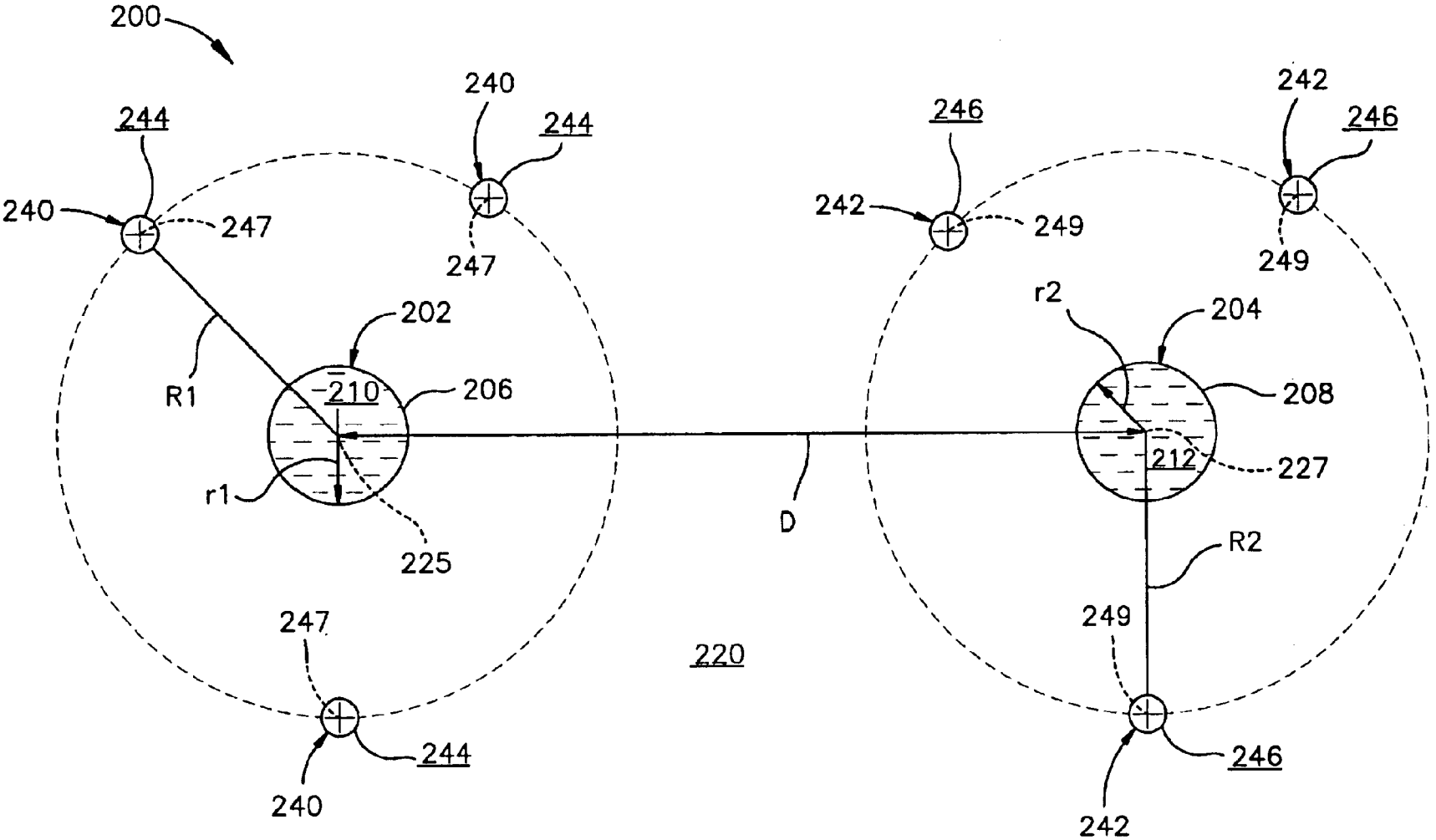
FIG. 2 is a schematic view of an apparatus comprising a second example of the claimed invention.

An apparatus 200 comprising a second embodiment of the invention is shown in a front view in FIG. 2. The second embodiment of the invention includes first and second burners 202 and 204 in a row. Annular open ends 206 and 208 of the burners 202 and 204 define first and second burner ports 210 and 212, respectively. The burners 202 and 204 communicate with a reaction zone 220 through the burner ports 210 and 212. The first and second burner ports 210 and 212 are centered on first and second burner axes 225 and 227 and have first and second radii (r1) and (r2), respectively.

Additional inlet fuel structures 240 and 242 are arranged in arrays of three that are centered on the first and second burner axes 225 and 227. The fuel structures 240 and 242 communicate with the reaction zone 220 through fuel ports 244 and 246, respectively. The fuel ports 244 and 246 are each centered on respective fuel port axes 247 and 249. The fuel port axes 247 are spaced from the first burner axis 225 a distance R1 in a range of about twice the radius r1 to about six times the radius r1. Similarly, the fuel port axes 249 are spaced from the second burner axis 227 a distance R2 in a range of about twice the radius r2 to about six times the radius r2. The first burner axis 225 is spaced from the second burner axis 227 a distance (D) that is greater than the sum of the distances R1 and R2.

Figure 3:
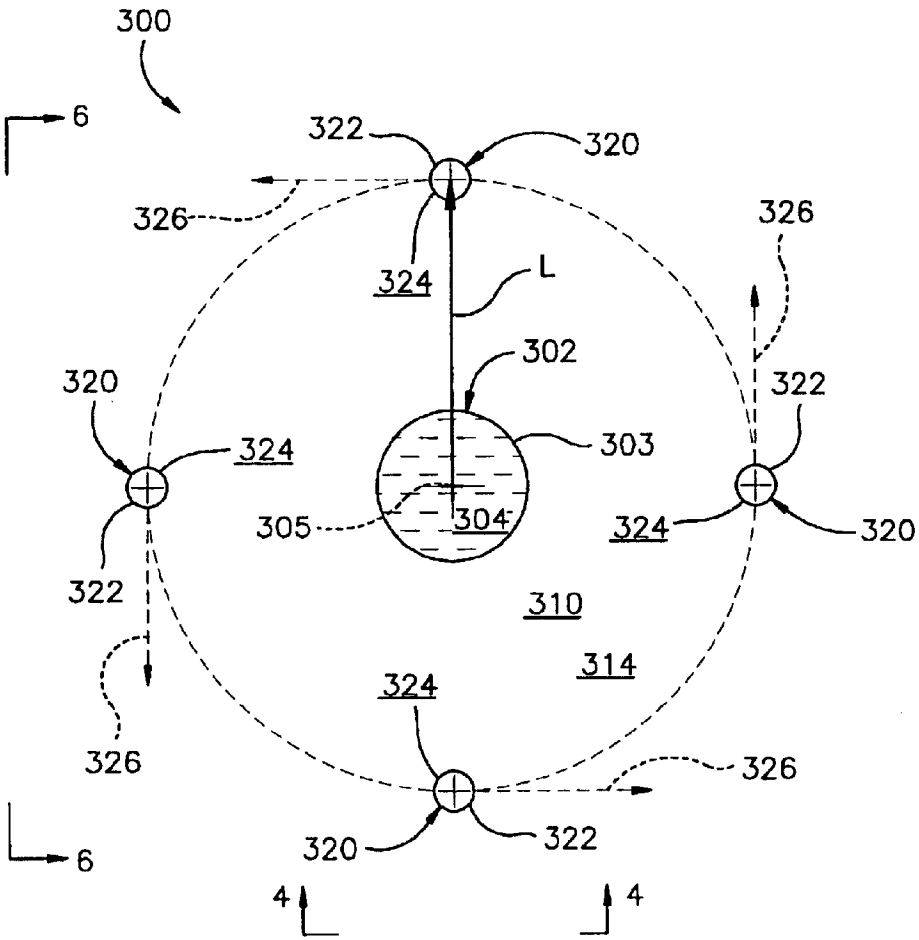
FIG. 3 is a schematic view of an apparatus comprising a third example of the claimed invention.

An apparatus 300 comprising a third embodiment of the invention is shown in FIG. 3. The third embodiment includes a burner 302 that has an open end 303. The open end 303 defines a burner port 304 that is centered on a burner axis 305. The burner 302 communicates through an end wall 310 with a reaction zone 312 (see FIG. 4). The end wall 310 has a planar surface 314 perpendicular to the burner axis 305 and is similar in function and location to the end wall 106.

Figure 4:
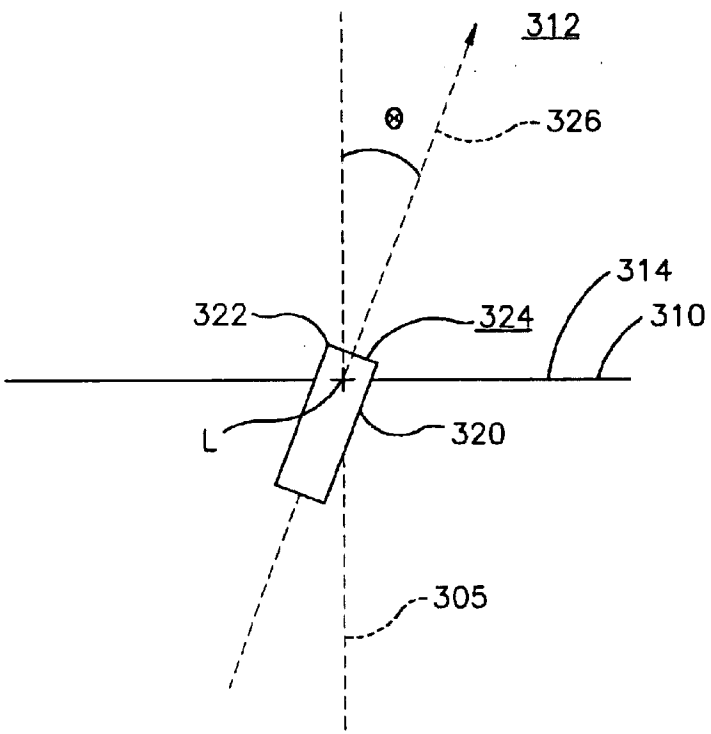
FIG. 4 is a view taken on line 4—4 of FIG. 3.

The furnace 300 also includes fuel inlet structures 320 in an array of four that is centered on the burner axis 305. The fuel structures 320 have open ends 322 that define respective fuel ports 324. Each fuel port 324 is centered on a respective fuel port axis 326 and each fuel port axis 326 is skewed relative to the burner axis 305. Skewed means that each fuel port axis 326 is rotated about a respective line that extends from the burner axis 305 to the fuel port axis 326. One such line (L) is shown in FIG. 3. The line (L) is perpendicular to both the burner axis 305 and the fuel port axis 326. Additionally, the line (L) has a length within a range of about twice to about six times the radius (r). As shown in FIG. 4, each fuel port axis 326 is rotated about its respective line (L) by an amount (Θ) expressed in degrees and is thus skewed relative to the burner axis 305. The amount (Θ) is preferably within the range of from about 10 degrees to about 30 degrees. In the example shown in FIG. 4, the corresponding axis 326 is skewed relative to the burner axis 305 by about 20 degrees.

Figure 6:
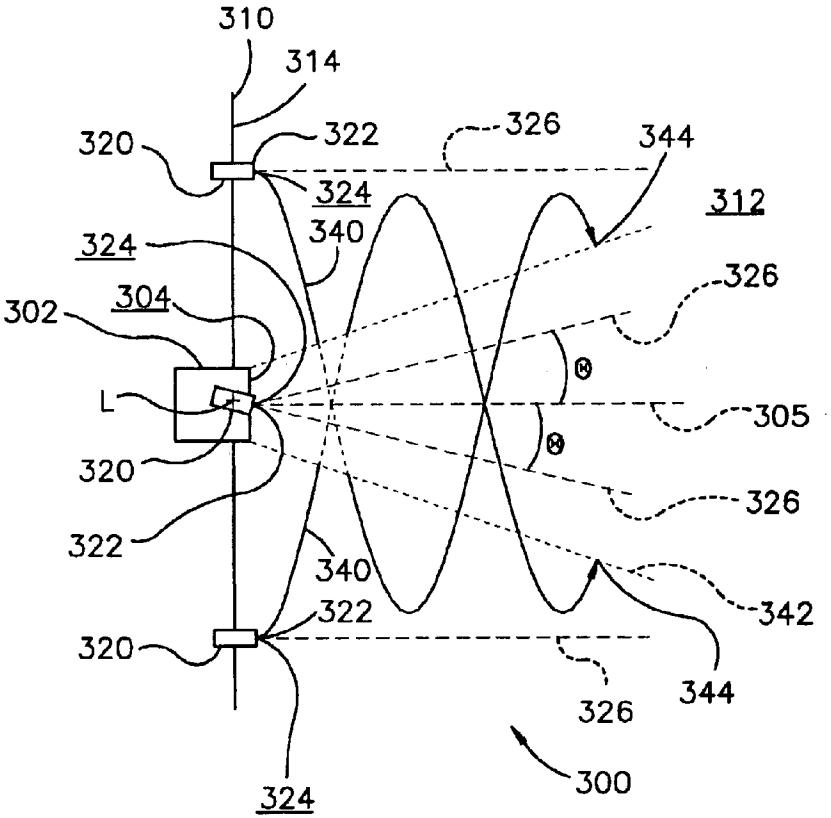
FIG. 6 is a view taken on line 6—6 of FIG. 3.
Figure 5:
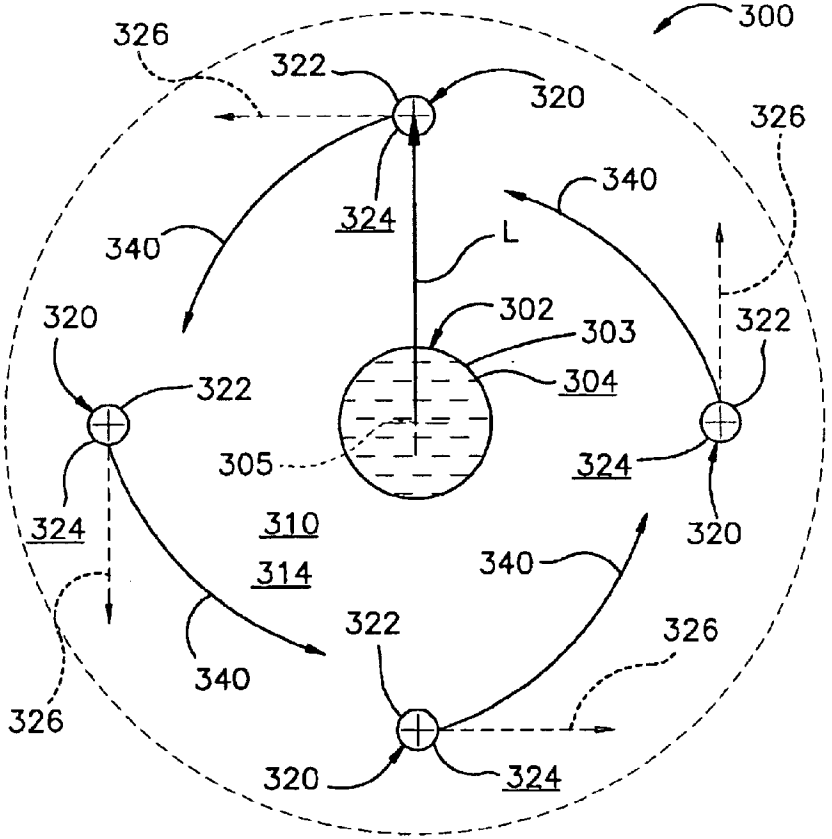
FIG. 5 is a view similar to FIG. 3.

With reference to FIGS. 5 and 6, flows of fuel are supplied from the fuel inlet structures 320 to the reaction zone 312 through the fuel ports 324. The fuel flows along spiral flow paths 340. The flow paths 340 start at the fuel ports 324 and extend axially from the fuel ports 324 into the reaction zone 312. As they extend into the reaction zone 312, the flow paths 340 spiral radially inward toward the burner axis 305. In this embodiment, the flow paths 340 spiral due to several factors. These factors include the influence of recirculation gas impingement, the configuration of the reaction zone 312, a fuel flow pumping action, and the skew of the fuel ports 324. With reference to FIG. 6, only two of the four flow paths 340 are shown for clarity of illustration.

As the fuel flows along the flow paths 340, it entrains inert gases that dilute the fuel. The amount of dilution is proportional to the length of the flow paths 340. The dilution of the fuel can reduce the formation of local hotspots when that fuel is combusted. Such a reduction in the number of local hotspots can result in a corresponding reduction of $NO_x$ production.

With reference to FIGS. 5 and 6, the burner 302 directs a flow of premix 342 into the reaction zone 312 through the burner port 304. The premix flow 342 expands radially outward as it enters the reaction zone 312 through the burner port 304, and thus becomes conical. Because the premix flow 342 expands outward and the flow paths 340 spiral radially inward, the flow paths 340 intersect the conical premix flow 342 at intersection locations 344. That is, fuel that is flowing along the flow paths 340 impinges the premix flow 342 at the intersection locations 344.

The fuel flowing along the flow paths 340 ignites when it impinges the premix flow 342. Because it has entrained inert gases while flowing along the flow paths 340, it has become diluted. The dilution of the fuel results in a reduction in the amount of $NO_x$ produced by the combustion of the diluted fuel.

Figure 7:
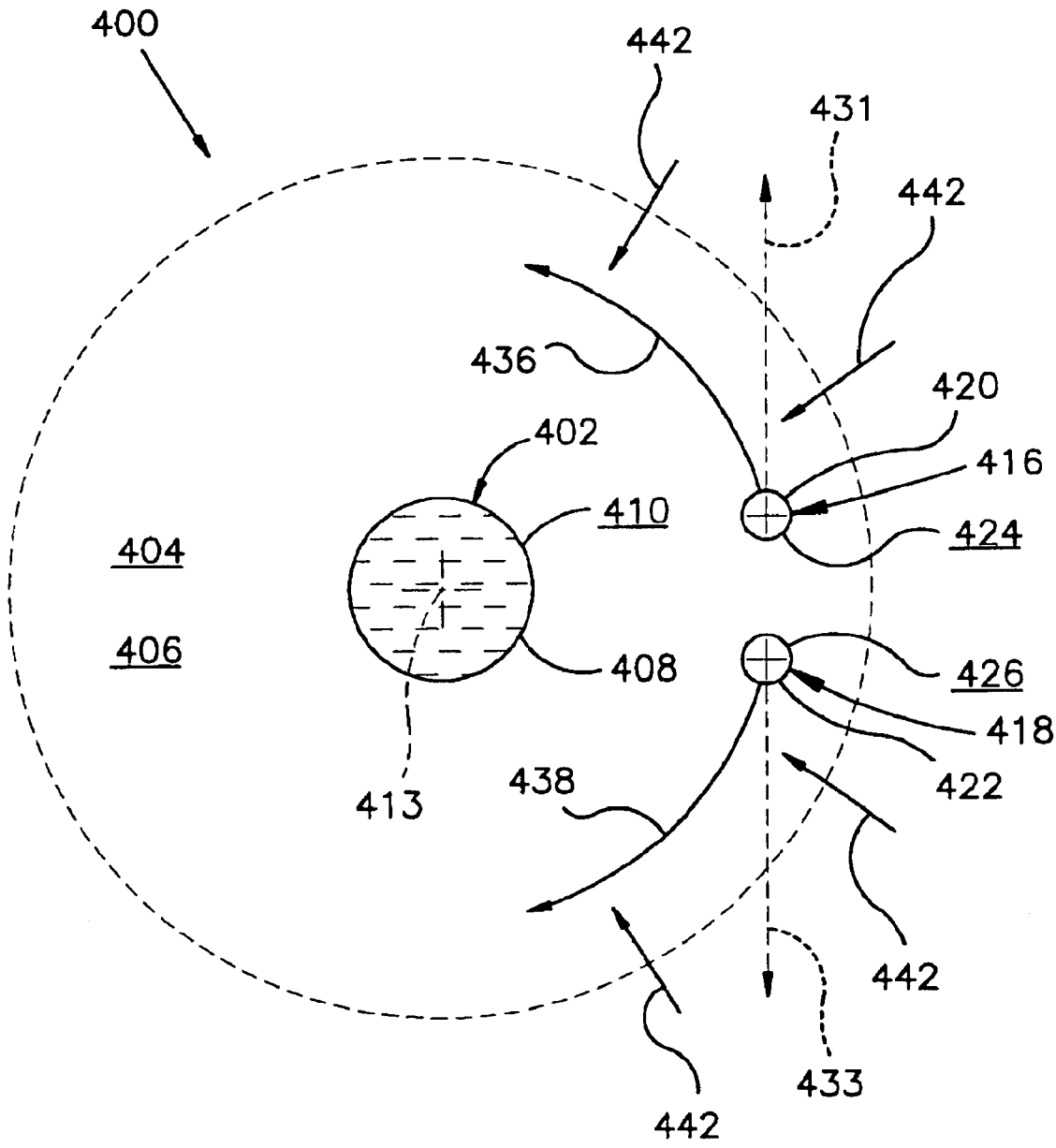
FIG. 7 is a schematic view of an apparatus comprising a fourth example of the claimed invention.

An apparatus 400 comprising a fourth embodiment of the invention is shown in FIG. 7. The apparatus 400 is a furnace that differs from the furnaces of previously described embodiments in that the directions of fuel flow paths in this embodiment differ from the directions of the previously described fuel flow paths.

The apparatus 400 includes a burner 402 that is coplanar with a planar surface 404 of an end wall 406. The end wall 406 is like the end walls 106 and 310 described above. The burner 402 has an open end 408. The open end 408 defines a burner port 410 centered on a burner axis 413.

Fuel inlet structures 416 and 418 also are included in the furnace 400. The fuel structures 416 and 418 each have open ends 420 and 422 that define fuel port 424 and 426, respectively. The fuel ports 424 and 426 are centered on respective fuel port axes 431 and 433. The fuel ports 424 and 426 are skewed such that, in combination with other factors, the fuel emerging from the fuel ports 424 and 426 flows along flow paths indicated by arrows 436 and 438, respectively. The factors include, for example, flows of recirculation gases, shown by directional arrows 442, which impinge on the fuel flowing along flow paths 436 and 438, and other factors as described above.

The apparatus 400 operates in a manner similar to the apparatus 300. The flow path 436 is a spiral flow path about the burner axis 413 and away from the end wall 406. The direction of the flow path 438 around the burner axis 413 is opposite that of the flow path 436.

Figure 8B:
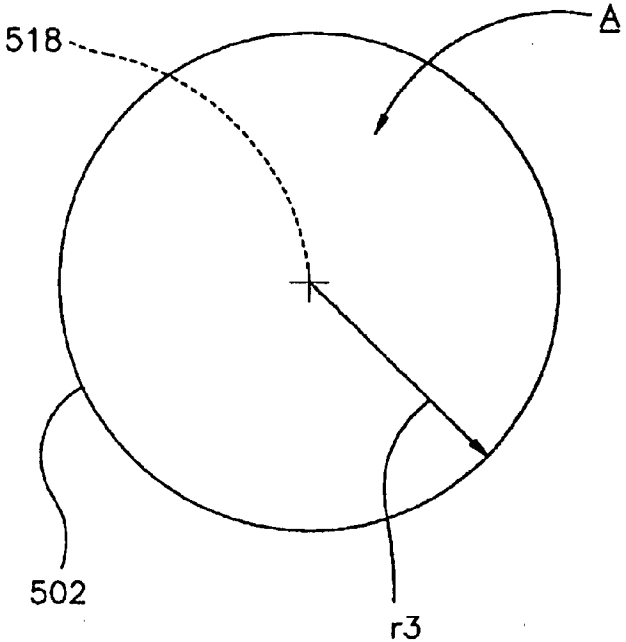
FIG. 8*b* is a schematic front view an imaginary circle.
Figure 8A:
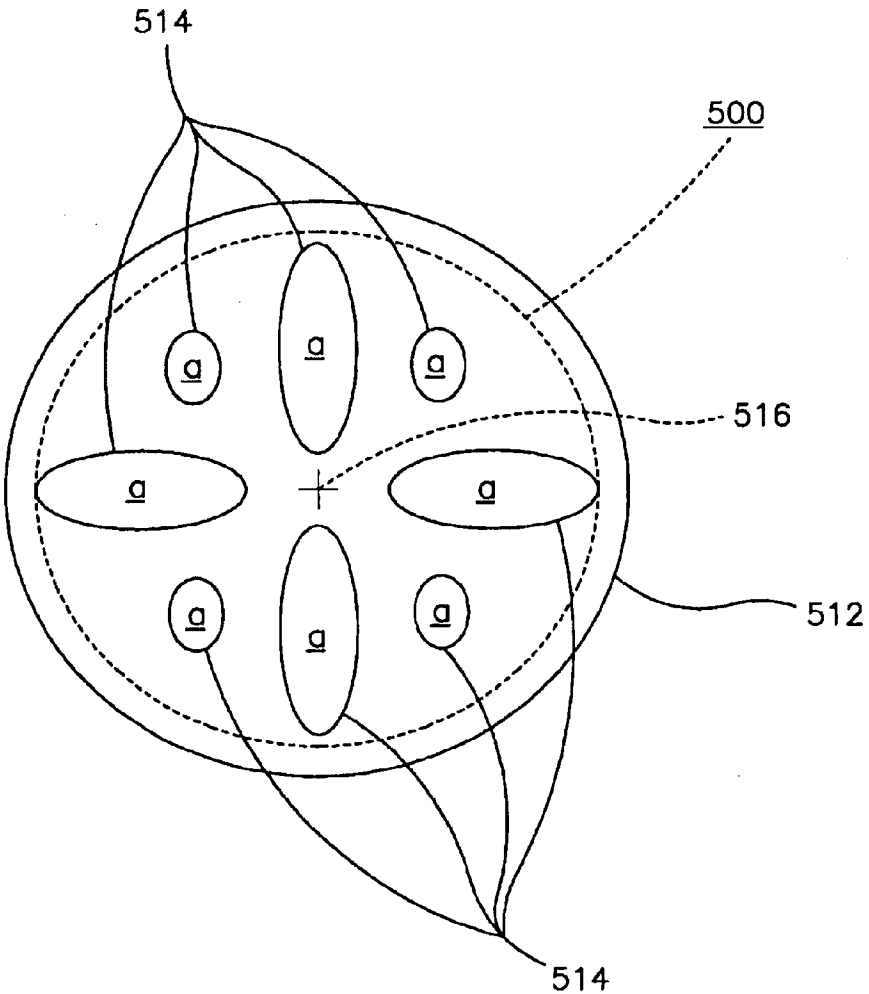
FIG. 8*a* is a schematic front view of a burner port configuration.

With reference to FIGS. 8*a* and 8*b*, and in accordance with the present invention, a burner port 500 may be non-circular. If the burner port 500 is non-circular, then the radius of an imaginary circle 502 is used to determine the radius (r) for spacing of a fuel port from the burner port 500 in accordance with the invention.

This imaginary circle 502 has a flow area equivalent to a modified or an unmodified flow area of the non-circular burner port 500. "Unmodified flow area" means the effective flow area of the burner port 500 and that no structures or configurations have increased or decreased the flow area of the burner port 500. "Modified flow area" means the effective flow area of the burner port 500 in addition to any increases or decreases in the total flow area created by additional structures or configurations.

In this embodiment, the effective flow area is modified in that the burner port 500 is covered by a perforated plate 512 that restricts the flow through the burner port 500. The plate 512 is preferably flat and defines a non-circular, non-contiguous and smaller effective flow area compared to the flow area of the burner port 500. Separate flow areas (a) through the plate 512 are defined by an array of apertures 514 in the plate 512. With reference to FIG. 8*a*, the array of apertures 514 has a centroid 516, about which the flow areas of the array 514 are evenly distributed. The smaller effective flow area is the sum of the separate flow areas (a).

As mentioned above, the imaginary circle 502 is used to determine the radius (r). The size of the imaginary circle 502 is determined by setting its flow area (A) equivalent to the effective flow area. The circle 502 has a center 518 and a radius (r3) that are dependent on the effective flow area. The radii (r) and (r3) are equivalent. In accordance with the invention, a fuel port, like the fuel ports described above, is then spaced a distance about twice to about six times the radius (r3) as measured from the centroid 516.

Figure 9:
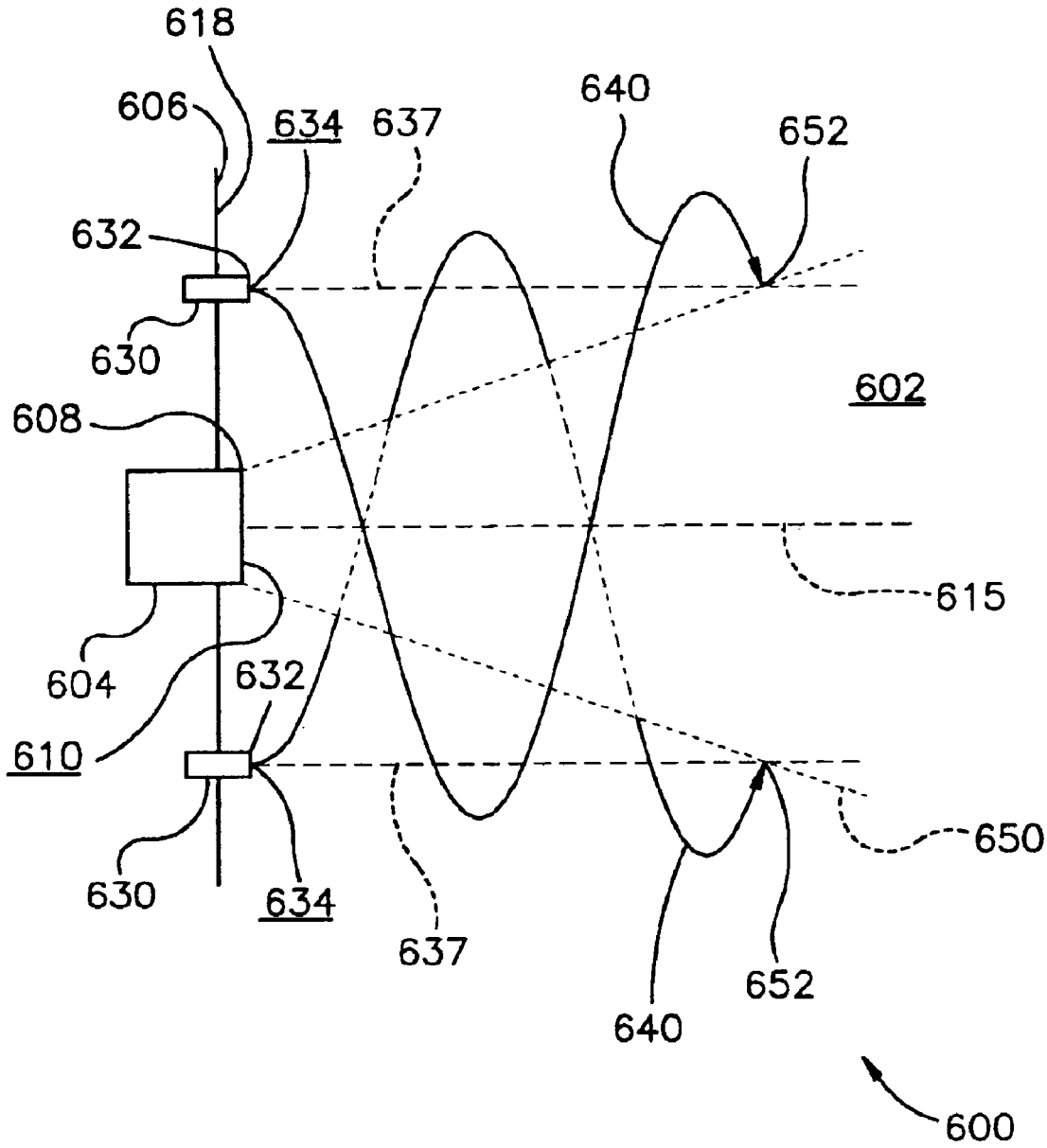
FIG. 9 is a schematic view of an apparatus comprising a fifth example of the claimed invention.

With reference to FIG. 9, an apparatus 600 comprising a fifth embodiment of the invention is shown in a side view similar to the view shown in FIG. 6. The furnace 600 operates in a manner similar to the furnace 300 but differs in how the fuel flows into a reaction zone 602 similar to the reaction zone 312.

The furnace 600 includes a burner 604 that extends through an end wall 606, which is similar to the end wall 320, and communicates with the reaction zone 602. The burner 604 has an open end 608 that defines a burner port 610 centered on a burner axis 615. The burner 604 communicates with a reaction zone 602 through the burner port 610. The end wall 606 has a planar surface 618 that is perpendicular to the burner axis 615.

The furnace 600 further includes two fuel structures 630 having open ends 632 defining respective fuel ports 634. The fuel ports 634 are centered on respective fuel port axes 637. The fuel structures 630 direct additional fuel to the reaction zone 602 through the fuel ports 634 and along flow paths 640. The fuel structures 630 are skewed such that the flow paths 640, while moving away axially from the fuel ports 634, spiral radially about the burner axis 615 and do not move inward toward the burner axis 615. Rather, the flow paths 640 stay at about the same distance from or move slightly away from the burner axis 615 as distance from the burner axis 615 to one of the fuel port axes 637.

In this embodiment, the reaction chamber 602 has a more open configuration than the reaction chamber 103 of the embodiment shown in FIG. 1. The open configuration does not have the choke configuration described above. Without the choke configuration there is a lesser effect by the reaction chamber 602, as compared to the reaction chamber 103, on combustion gas recirculation. The combustion gas recirculation can affect the direction of the fuel flowing along the flow paths 640. Accordingly, the lesser effect of the choke configuration on the combustion gas recirculation creates a correspondingly lesser effect on the direction of the fuel flowing along the flow paths 640. Because the direction of the fuel is not as affected, the fuel flowing along the flow paths 640 does not spiral radially inward as it would otherwise in previously described embodiments. That is, the flow paths 640 stay at about the same or a greater distance from the burner axis 615 as they spiral around the burner axis 615.

During operation, a flow of premix 650 diverges radially outward from the burner axis 615 as it moves axially from the burner port 610 into the reaction zone 602. This divergence imparts a conical configuration to the flow of premix 650. In addition to the flow of premix 650 from the burner port 610, fuel is introduced into the reaction chamber 602 through the fuel ports 634. The fuel travels along the flow paths 640 under the influence of the factors described above.

The flow of premix 650 intersects the flow paths 640 at intersection locations 652. The intersection locations 652 are at or near the same radial distance from the burner axis 615 as are the fuel ports 630. The fuel flowing along the flow paths 640 entrains inert combustion products as it flows to the intersection locations 652 along the flow paths 640. Upon reaching the intersection locations 652, the fuel ignites and combusts. By entraining the inert gases prior to intersecting the oxidant rich flow of premix 650, the fuel can combust with a decreased amount of hotspots. Decreased amounts of hotspots can result in a decreased amount of $NO_x$ production by the combustion of the fuel.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An apparatus comprising:

a wall structure defining a reaction zone, including a wall facing into said reaction zone;

a burner structure extending through said wall to communicate with said reaction zone through a burner port facing into said reaction zone from said wall, said burner port being centered on a burner axis; and a fuel inlet structure extending through said wall to communicate with said reaction zone through a fuel port facing into said reaction zone from said wall, said fuel port being centered on a fuel port axis that is skewed relative to said burner axis in a plane parallel to said burner axis.

2. An apparatus as defined in claim 1, wherein said fuel port axis is skewed relative to said burner axis an amount within a range of about 10 degrees to about 30 degrees.

3. An apparatus as defined in claim 2, wherein said fuel port axis is skewed relative to said burner axis by about 20 degrees.

4. An apparatus as defined in claim 1, wherein said fuel port is skewed relative to said burner port such that fuel emerging from said fuel port follows a spiral flow path about said burner axis.

5. An apparatus as defined in claim 4, further comprising a second fuel port, and said second fuel port is skewed relative to said burner port in a plane parallel to said burner axis such that additional fuel emerging from said second fuel port follows a second spiral flow path about said burner axis opposite said spiral flow path.

6. An apparatus comprising:

a wall structure defining a reaction zone, including a wall facing into said reaction zone;

a burner structure extending through said wall to communicate with said reaction zone through a burner port facing into said reaction zone from said wall, said burner port being centered on a burner axis and having a radius; and a fuel inlet structure extending through said wall to communicate with said reaction zone through a fuel port facing into said reaction zone from said wall, said fuel port being centered on a fuel port axis that is spaced radially from said burner axis a distance within a range from about twice said radius of said burner port to about six times said radius of said burner port;

wherein said fuel port axis is skewed relative to said burner axis in a plane parallel to said burner axis.

7. An apparatus as defined in claim 6, wherein said fuel port axis is skewed relative to said burner axis an amount within a range from about 10 degrees to about 30 degrees.

8. An apparatus as defined in claim 7, wherein said fuel port axis is skewed relative to said burner axis by about 20 degrees.

9. An apparatus as defined in claim 6, wherein said fuel port is skewed relative to said burner port such that fuel emerging from said fuel port follows a spiral flow path about said burner axis.

10. An apparatus as defined in claim 9, further comprising a second fuel port, and said second fuel port is skewed relative to said burner port in a plane parallel to said burner axis such that additional fuel emerging from said second fuel port follows a second spiral flow path about said burner axis opposite said spiral flow path.

11. An apparatus comprising:

a furnace structure defining a reaction zone;

a burner structure communicating with said reaction zone through a burner port, said burner port being centered on a burner axis and having a radius;

a fuel inlet structure communicating with said reaction zone through a fuel port, said fuel port being centered on a fuel port axis that is spaced radially from said burner axis a distance within a range from about twice said radius to about six times said radius of said burner port;

a second burner structure communicating with said reaction zone through a second burner port, said second burner port being centered on a second burner axis and having a second radius; and a second fuel inlet structure communicating with said reaction zone through a second fuel port, said second fuel port being centered on a second fuel port axis that is spaced radially from said second burner axis a second distance, said second distance being within a range from about twice to about six times said second radius of said second burner port;

wherein said burner axes are spaced from each other an amount that is greater than the sum of said distances; and wherein said fuel port axis is skewed relative to said burner axis in a plane parallel to said burner axis.

12. An apparatus as defined in claim 11, wherein said fuel port axis is skewed relative to said burner axis an amount within a range from about 10 degrees to about 30 degrees.

13. An apparatus as defined in claim 12, wherein said fuel port axis is skewed relative to said burner axis by about 20 degrees.

14. An apparatus as defined in claim 11, wherein said fuel port is skewed relative to said burner port such that fuel emerging from said fuel port follows a spiral flow path about said burner axis.

15. An apparatus as defined in claim 14, further comprising a second fuel port, and said second fuel port is skewed relative to said burner port in a plane parallel to said burner axis such that additional fuel emerging from said second fuel port follows a second spiral flow path about said burner axis opposite said spiral flow path.

* * * * *